US008695548B2

(12) United States Patent
Kato et al.

(10) Patent No.: US 8,695,548 B2
(45) Date of Patent: Apr. 15, 2014

(54) VALVE TIMING CONTROL APPARATUS

(75) Inventors: Ichiro Kato, Gamagori (JP); Tadao Ikihara, Okazaki (JP); Yuuki Matsunaga, Chiryu (JP)

(73) Assignee: Denso Corporation, Kariya (JP)

( * ) Notice: Subject to any disclaimer, the term of this patent is extended or adjusted under 35 U.S.C. 154(b) by 146 days.

(21) Appl. No.: 13/313,209

(22) Filed: Dec. 7, 2011

(65) Prior Publication Data

US 2012/0145099 A1 Jun. 14, 2012

(30) Foreign Application Priority Data

Dec. 10, 2010 (JP) ..... 2010-276009
Dec. 10, 2010 (JP) ..... 2010-276010

(51) Int. Cl.
*F01L 1/34* (2006.01)

(52) U.S. Cl.
USPC ..... 123/90.17; 123/90.15; 464/160

(58) Field of Classification Search
USPC ..... 123/90.15, 90.17; 464/160
See application file for complete search history.

(56) References Cited

U.S. PATENT DOCUMENTS

| | | | |
|---|---|---|---|
| 7,533,695 | B2 | 5/2009 | Strauss et al. |
| 7,581,560 | B2 | 9/2009 | Koch et al. |
| 2005/0252467 | A1 | 11/2005 | Strauss et al. |
| 2006/0118072 | A1 | 6/2006 | Meintschel et al. |
| 2007/0056540 | A1 | 3/2007 | Hoppe et al. |
| 2009/0145386 | A1 | 6/2009 | Ushida |

*Primary Examiner* — Ching Chang
(74) *Attorney, Agent, or Firm* — Nixon & Vanderhye P.C.

(57) ABSTRACT

A springless check valve enables flow of hydraulic fluid from a supply port toward a corresponding one of an advancing port and a retarding port in a connection passage upon lifting of a valve member from a valve seat and limits flow of the hydraulic fluid from the corresponding one of the advancing port and the retarding port toward the supply port upon seating of the valve member against the valve seat. In a synchronously rotatable member, a drain passage is circumferentially displaced from the drain port, and an advancing passage is placed at a corresponding circumferential position, which coincides with a circumferential position of the advancing port. Furthermore, a retarding passage is placed at a corresponding circumferential position, which coincides with a circumferential position of the retarding port.

8 Claims, 12 Drawing Sheets

VALVE TIMING CONTROL APPARATUS

CROSS REFERENCE TO RELATED APPLICATION

This application is based on and incorporates herein by reference Japanese Patent Application No. 2010-276009 filed on Dec. 10, 2010 and Japanese Patent Application No. 2010-276010 filed on Dec. 10, 2010.

BACKGROUND OF THE INVENTION

1. Field of the Invention

The present invention relates to a valve timing control apparatus of an internal combustion engine.

2. Description of Related Art

A previously proposed valve timing control apparatus includes a housing, which is rotated synchronously with a crankshaft, and a vane rotor, which is rotated synchronously with a camshaft. For example, Japanese Unexamined Patent Publication JP2005-325841A (corresponding to U.S. Pat. No. 7,533,695 B2) teaches such a valve timing control apparatus, which changes the rotational phase of the vane rotor relative to the housing toward one of an advancing side and a retarding side by supplying hydraulic fluid into a corresponding one of an advancing chamber and a retarding chamber, which are arranged one after another in a rotational direction and are partitioned by the vane rotor in an inside of the housing. This valve timing control apparatus has a control valve, which controls input and output of the hydraulic fluid relative to the advancing chamber and the retarding chamber.

Specifically, during an operation in a phase change mode (advancing mode or retarding mode) for changing the rotational phase, the control valve feeds the hydraulic fluid, which is supplied from a supply source to a supply port of the control valve, to one of the advancing chamber and the retarding chamber through a feed port (advancing port or retarding port) connected to the supply port. At this time, in a connection passage, which connects the supply port to the feed port, a check valve is operated in response to alternation in an oscillating torque, which is applied from the camshaft to the vane rotor.

First of all, when the oscillating torque is exerted in a direction for increasing a volume of a subject one of the advancing chamber and the retarding chamber, to which the hydraulic fluid is fed from the feed port, a negative pressure is generated in the subject one of the advancing chamber and the retarding chamber. Therefore, in the connection passage, which is connected to the subject one of the advancing chamber and the retarding chamber, the flow of the hydraulic fluid from the supply port to the feed port is enabled by the check valve. Therefore, the hydraulic fluid, which is supplied from the supply source to the supply port, is fed to the subject one of the advancing chamber and the retarding chamber through the feed port, so that the rotational phase of the vane rotor relative to the housing is changed. In contrast, when the oscillating torque is exerted in a direction for reducing the volume of the subject one of the advancing chamber and the retarding chamber, the hydraulic fluid of the subject one of the advancing chamber and the retarding chamber is discharged to the connection passage through the feed port. Thus, in the connection passage, the flow of the hydraulic fluid from the feed port to the supply port is limited by the check valve. Thereby, returning of the rotational phase, which would be caused by the discharge of the hydraulic fluid from the subject one of the advancing chamber and the retarding chamber, is limited.

In JP2005-325841A (corresponding to U.S. Pat. No. 7,533,695 B2), the check valve of the control valve is a spring equipped check valve, in which a valve member is urged by a spring against a valve seat. Therefore, a valve closing speed of the check valve at the time of seating the valve member against the valve seat using a restoring force of the spring is high. However, a valve opening speed of the check valve at the time of lifting the valve member away from the valve seat against the restoring force of the spring is low. Furthermore, the valve member of the check valve of the valve timing control apparatus recited in JP2005-325841A (corresponding to U.S. Pat. No. 7,533,695 B2) is formed as a solid spherical ball. Therefore, in the lifted state of the valve member away from the valve seat, when the hydraulic fluid, which flows toward the feed port in the connection passage, collides against the valve member, a substantial reduction in the amount of pressure loss of the hydraulic fluid may possibly occur. Thereby, the supply of the hydraulic fluid to the subject one of the advancing chamber and the retarding chamber may be delayed, thereby resulting in a reduction in a response speed for adjusting the valve timing, which corresponds to the rotational phase.

Furthermore, Japanese Unexamined Patent Publication JP2009-138611A (corresponding to US2009/0145386A1) teaches another valve timing control apparatus. In this valve timing control apparatus, a sleeve has a supply port, a drain port, an advancing port and a retarding port. The supply port receives the hydraulic fluid from a supply source. The drain port is open to the atmosphere and discharges the hydraulic fluid. The hydraulic fluid is fed to or discharged from the advancing chamber through the advancing port. Also, the hydraulic fluid is fed to or discharged from the retarding chamber through the retarding port. During the operation of the valve timing control apparatus in an advancing mode, which changes the rotational phase to an advancing side, the advancing port and the supply port are communicated with each other to feed the hydraulic fluid to the advancing chamber, and the retarding port is communicated with the drain port to discharge the hydraulic fluid from the retarding chamber. During the operation of the valve timing control apparatus in a retarding mode, which changes the rotational phase to a retarding side, the retarding port and the supply port are communicated with each other to feed the hydraulic fluid to the retarding chamber, and the advancing port is communicated with the drain port to discharge the hydraulic fluid from the advancing chamber.

In the valve timing control apparatus of JP2009-138611A (corresponding to US2009/0145386A1), the drain port, which is formed in the sleeve of the control valve received in the camshaft on the radially inner side of the vane rotor, is opened to the atmosphere through a drain passage that extends through the camshaft. The drain port, which is displaced from the advancing port and the retarding port in the axial direction of the sleeve, is formed such that a circumferential position of the drain port in a circumferential direction of the sleeve coincides with a circumferential position of the drain passage. Therefore, a length of a discharge passage of the hydraulic fluid from the retarding port or the advancing port to the drain passage may possibly become insufficient to cause a reduction in the amount of pressure loss in the discharge passage during the operation in the advancing mode or the retarding mode. In such a case where the amount of the pressure loss at the discharge passage is reduced, i.e., becomes small, an excessive quantity of the hydraulic fluid is discharged from the corresponding one of the advancing chamber and the retarding chamber through the discharge passage. Thereby, a negative pressure is generated in the other one of the advancing chamber and the retarding chamber, to which the hydraulic fluid is currently fed, due to an increase in the volume of the other one of the advancing chamber and the retarding chamber. When the air is drawn into the other one of the advancing chamber and the retarding chamber, an apparent elastic modulus of a mixture of the air and the hydraulic fluid becomes small in the other one of the advancing chamber and the retarding chamber to cause fluctuating movement of the vane rotor. Therefore, it is difficult to achieve a high response speed for adjusting the valve timing, which corresponds to the rotational phase.

Furthermore, in the valve timing control apparatus of JP2009-138611A (corresponding to US2009/0145386A1), an advancing passage extends through the vane rotor and the camshaft to communicate between the advancing chamber and the advancing port, and the advancing port is displaced from the advancing passage in the circumferential direction of the sleeve. Therefore, during the operation in the retarding mode, the amount of pressure loss is increased in the discharge passage, which extends from the advancing passage to the advancing port, so that the response speed for adjusting the valve timing can be improved. However, during the operation in the advancing mode, this discharge passage is used as a feed passage of the hydraulic fluid, which extends from the advancing port to the advancing passage, and the increased amount of pressure loss in this feed passage disadvantageously causes a reduction in the response speed for adjusting the valve timing.

SUMMARY OF THE INVENTION

The present invention is made in view of the above disadvantages. Thus, it is an objective of the present invention to provide a valve timing control apparatus, which improves a response speed for adjusting valve timing.

According to the present invention, there is provided a valve timing control apparatus, which includes a housing, a vane rotor and a control valve. The housing is rotatable synchronously with a crankshaft of an internal combustion engine. The vane rotor is rotatable synchronously with a camshaft of the internal combustion engine. The vane rotor partitions between an advancing chamber and a retarding chamber in a rotational direction in an inside of the housing. A rotational phase of the vane rotor relative to the housing is changeable in one of an advancing side and a retarding side by feeding hydraulic fluid, which is supplied from a supply source, into a corresponding one of the advancing chamber and the retarding chamber. The control valve controls input and output of the hydraulic fluid relative to the advancing chamber and the retarding chamber. Valve timing of a valve, which is opened or closed by the camshaft, is adjusted by transmission of a torque from the crankshaft. The control valve includes a supply port, a feed port, a connection passage and a springless check valve. The hydraulic fluid is supplied to the supply port from the supply source during an operation in a phase change mode, which changes the rotational phase. The hydraulic fluid is fed to the one of the advancing chamber and the retarding chamber through the feed port during the operation in the phase change mode. The connection passage is connected to the supply port and the feed port during the operation in the phase change mode. The springless check valve enables flow of the hydraulic fluid from the supply port toward the feed port in the connection passage upon lifting of a valve member from a valve seat at the springless check valve during the operation in the phase change mode and limits flow of the hydraulic fluid from the feed port toward the supply port in the connection passage upon seating of the valve member against the valve seat during the operation in the phase change mode. The valve member includes a spherical plate portion, an annular ring portion and a plurality of bridge portions. The spherical plate portion includes a convex plate surface and a concave plate surface, which are opposed to each other and are configured into partial spherical surfaces, respectively, each having a circular outer peripheral edge. The convex plate surface is seatable and liftable relative the valve seat. The annular ring portion includes an inner peripheral surface and an outer peripheral surface. The inner peripheral surface of the annular ring portion has a diameter larger than that of the spherical plate portion. The outer peripheral surface of the annular ring portion is guided by a wall surface of the connection passage. The bridge portions are spaced from each other in a circumferential direction. The bridge portions coaxially connect the annular ring portion to the spherical plate portion.

According to the present invention, there is also provided a valve timing control apparatus, which includes a housing, a vane rotor and a control valve. The housing is rotatable synchronously with a crankshaft of an internal combustion engine. The vane rotor is rotatable synchronously with a camshaft of the internal combustion engine and thereby cooperates with the camshaft to form a synchronously rotatable member. The vane rotor partitions between an advancing chamber and a retarding chamber in a rotational direction in an inside of the housing. A rotational phase of the vane rotor relative to the housing is changeable in one of an advancing side and a retarding side by feeding hydraulic fluid, which is supplied from a supply source, into a corresponding one of the advancing chamber and the retarding chamber. The control valve is received in the synchronously rotatable member and controls input and output of the hydraulic fluid relative to the advancing chamber and the retarding chamber in response to an operational position of a spool, which is received in a sleeve. Valve timing of a valve, which is opened or closed by the camshaft, is adjusted by transmission of a torque from the crankshaft. The sleeve includes a supply port, a drain port, an advancing port and a retarding port. The hydraulic fluid is supplied from the supply source to the supply port. The drain port is opened to atmosphere, and the hydraulic fluid is discharged from the drain port. The advancing port is adapted to be communicated with the supply port to feed the hydraulic fluid to the advancing chamber during an operation in an advancing mode, which changes the rotational phase toward an advancing side. The advancing port is adapted to be communicated with the drain port to discharge the hydraulic fluid from the advancing chamber during an operation in a retarding mode, which changes the rotational phase toward a retarding side. The retarding port is adapted to be communicated with the supply port to feed the hydraulic fluid to the retarding chamber during the operation in the retarding mode. The retarding port is adapted to be communicated with the drain port to discharge the hydraulic fluid from the retarding chamber during the operation in the advancing mode. The drain port, the advancing port and the retarding port are displaced from each other in an axial direction of the sleeve. The synchronously rotatable member includes a drain passage, an advancing passage and a retarding passage. The drain passage is circumferentially displaced in a circumferential direction of the sleeve from the drain port, which is located on a radially inner side of the drain passage. The drain passage is formed as a through-hole and opens the drain port to the atmosphere. The advancing passage is placed in the circumferential direction of the sleeve at a corresponding circumferential position, which coincides with a circumferential position of the advancing port located on a radially inner side of the advancing passage. The advancing passage is formed as a through-hole and communicates the advancing port to the advancing chamber. The retarding passage is placed in the circumferential direction of the sleeve at a corresponding circumferential position, which coincides with a circumferential position of the retarding port located on a radially inner side of the retarding passage. The retarding passage is formed as a through-hole and communicates the retarding port to the retarding chamber.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
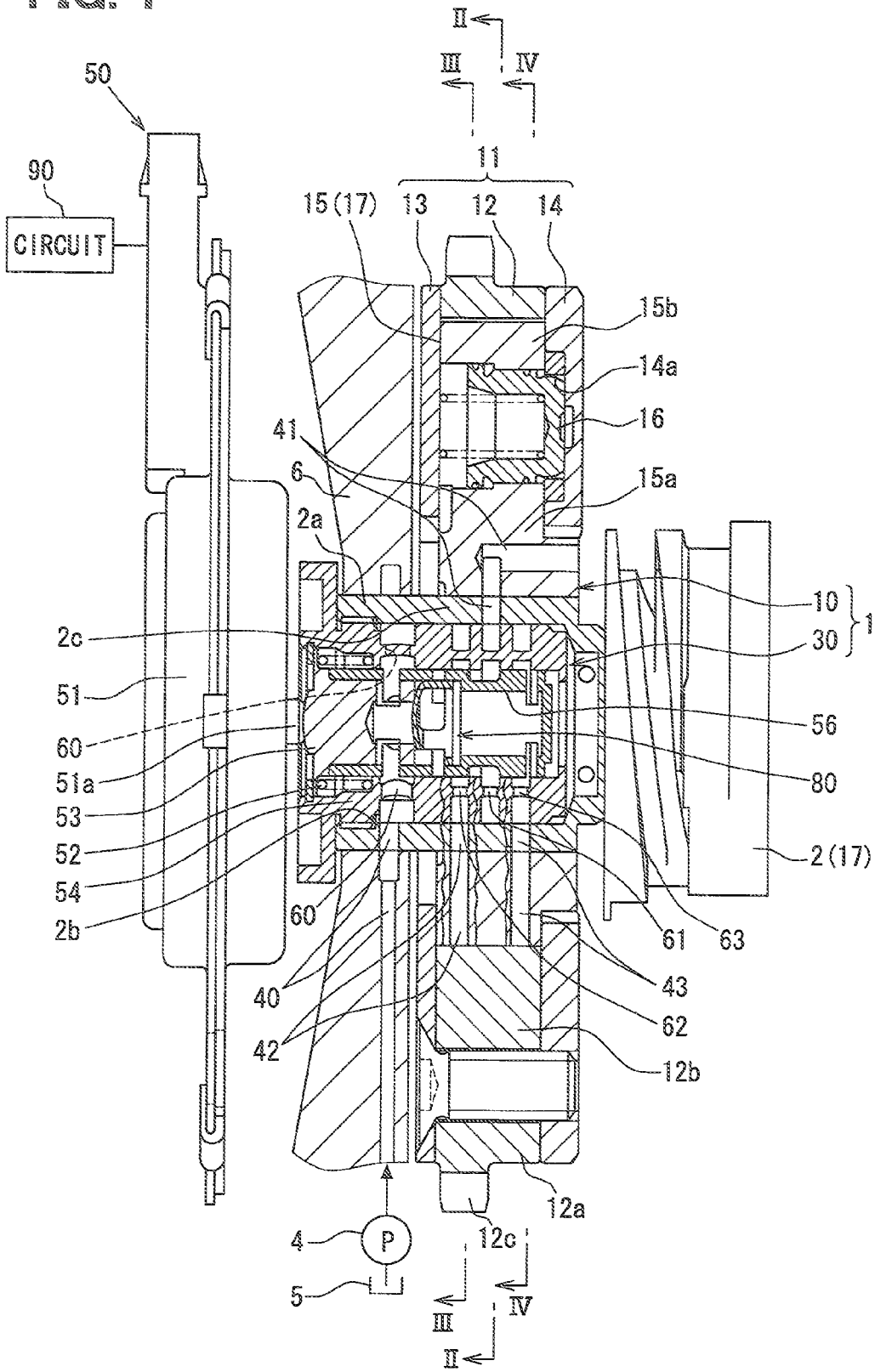
FIG. 1 is a cross sectional view taken along line I-I in FIG. 2, showing a structure of a valve timing control apparatus according to an embodiment of the present invention.

An embodiment of the present invention will be described with reference to the accompanying drawings. FIG. 1 shows a valve timing control apparatus 1 of the present embodiment installed to an internal combustion engine of a vehicle (e.g., an automobile). The valve timing control apparatus 1 is a hydraulically controlled type, which uses hydraulic oil as hydraulic fluid (also referred to as working fluid). The valve timing control apparatus 1 adjusts the valve timing of intake valves.

Figure 2:
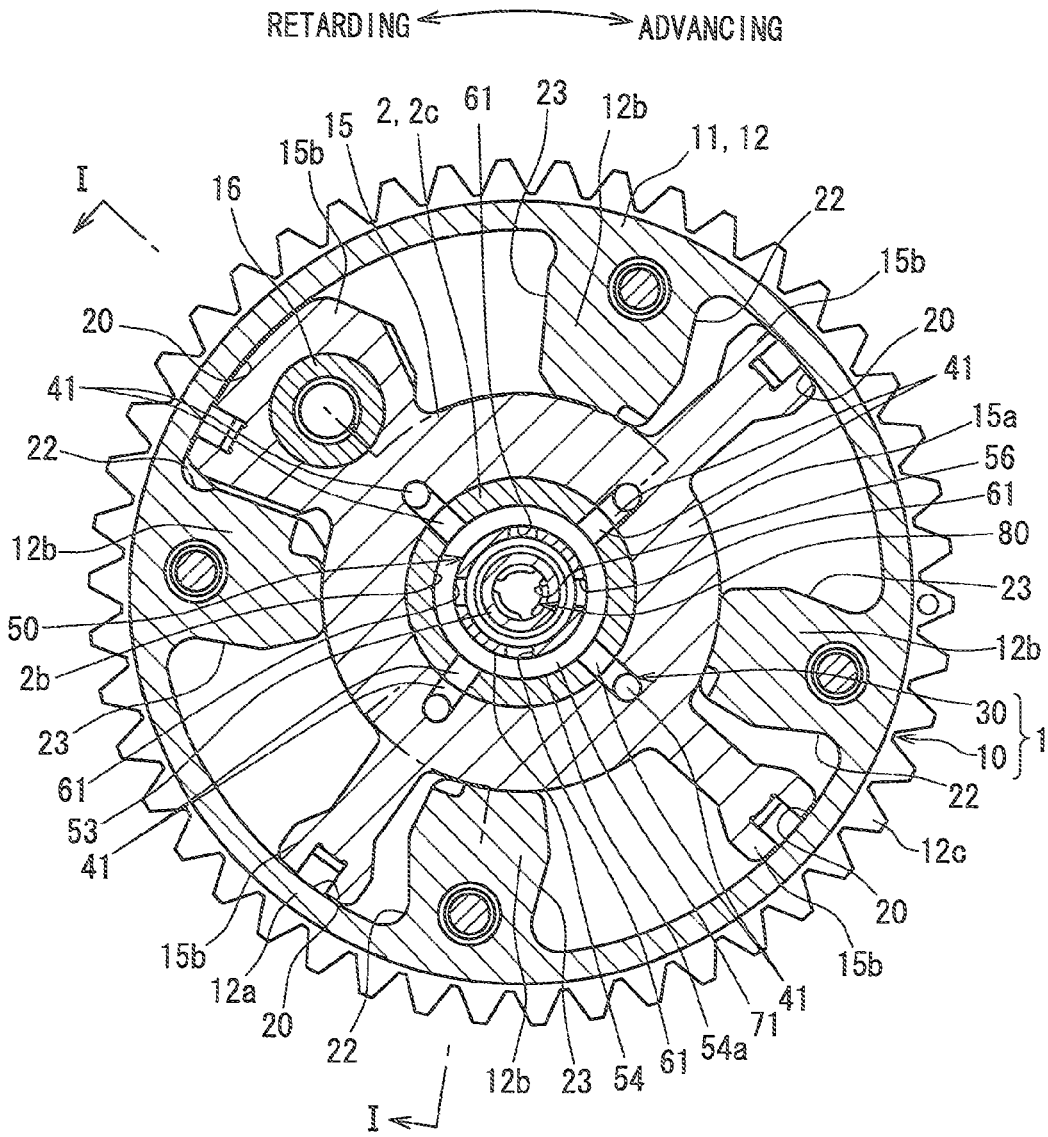
FIG. 2 is a cross sectional view taken along line II-III in FIG. 1.

Hereinafter, a basic structure of the valve timing control apparatus 1 will be described. As shown in FIGS. 1 and 2, the valve timing control apparatus 1 includes a drive device 10 and a control device 30. The drive device 10 is installed in a transmission system that transmits an engine torque, which is outputted from a crankshaft (not shown) of the engine, to a camshaft 2. The control device 30 controls input and output of the hydraulic oil, which drives the drive, device 10.

The drive device 10 includes a housing 11 and a vane rotor 15. The housing 11 includes a shoe casing 12, a front plate 13 and a rear plate 14. The front plate 13 and the rear plate 14 are securely connected to two opposed axial end portions, respectively, of the shoe casing 12. The shoe casing 12 includes a casing main body 12*a*, a plurality of shoes 12*b* and a sprocket portion 12*c*. The shoes 12*b* are arranged one after another at predetermined intervals in a rotational direction (circumferential direction) of the casing main body 12*a*, which is configured into a cylindrical tubular form, and the shoes 12*b* radially inwardly project from the casing main body 12*a*. A receiving chamber 20 is formed between each adjacent two of the shoes 12*b*, which are adjacent to each other in the rotational direction.

The sprocket portion 12*c* is connected to the crankshaft through a timing chain (not shown). When the engine is driven to rotate the crankshaft, the engine torque is transmitted from the crankshaft to the sprocket portion 12*c*. Therefore, the housing 11 is rotated synchronously with the crankshaft in a predetermined direction (clockwise direction in FIG. 2).

The vane rotor 15 is placed in an inside of the housing 11 such that the vane rotor 15 is coaxial with the housing 11. The vane rotor 15 includes a rotatable shaft 15*a* and a plurality of vanes 15*b*. The rotatable shaft 15*a*, which is configured into a cylindrical tubular form, is coaxially fixed to the camshaft 2. Thereby, the vane rotor 15 is rotatable synchronously with the camshaft 2 in the predetermined direction (clockwise direction in FIG. 2) and is rotatable relative to the housing 11. The vanes 15*b* are arranged one after another at predetermined intervals along the rotatable shaft 15*a* and radially outwardly project from the rotatable shaft 15*a*, so that the vanes 15*b* are received in the receiving chambers 20, respectively. Each vane 15*b* divides the corresponding receiving chamber 20 into an advancing chamber 22 and a retarding chamber 23, which are placed one after another in the rotational direction. Thereby, the multiple advancing chambers 22 and the multiple retarding chambers 23 are formed in the inside of the housing 11. In the present embodiment, each vane 15*b* forms the advancing chamber 22 relative to the adjacent shoe 12*b* located on a rear side of the vane 15*b* in the rotational direction and also forms the retarding chamber 23 relative to the other adjacent shoe 12*b* located on a front side of the vane 15*b* in the rotational direction.

One of the vanes 15*b* has a lock member 16. When the engine is stopped, the lock member 16 is fitted into a lock hole 14*a* of the rear plate 14, so that a rotational phase of the vane rotor 15 relative to the housing 11 is locked. At the time of starting the engine, the lock member 16 is removed from the lock hole 14*a*, so that a change in the rotational phase of the vane rotor 15 relative to the housing 11 is enabled during the time of steady operation of the engine.

With the above structure, at the time of steady operation of the engine, the rotational phase of the vane rotor 15 is changed by inputting or outputting the hydraulic oil relative to each corresponding advancing chamber 22 and each corresponding retarding chamber 23, and thereby the valve timing, which corresponds to the rotational phase, is implemented. Specifically, the rotational phase of the vane rotor 15 is changed to the advancing side thereof by inputting the hydraulic oil into each advancing chamber 22 to increase the volume of the advancing chamber 22 and outputting the hydraulic oil from each retarding chamber 23 to reduce the volume of the retarding chamber 23. Thereby, the valve timing is advanced. In contrast, the rotational phase of the vane rotor 15 is changed to the retarding side thereof by inputting the hydraulic oil into each retarding chamber 23 to increase the volume of the retarding chamber 23 and outputting the hydraulic oil from each advancing chamber 22 to reduce the volume of the advancing chamber 22. Thereby, the valve timing is retarded.

With reference to FIGS. 1 to 4, the control device 30 includes a supply passage 40, a plurality of drain passages 41, a plurality of advancing passages 42, a plurality of retarding passages 43, a control valve 50 and a control circuit 90. The supply passage 40 is communicated with an outlet of a pump (serving as a supply source) 4. Thus, the hydraulic oil, which is drawn from a drain pan 5 into an inlet of the pump 4, is discharged into the supply passage 40 through the outlet of the pump 4. The pump 4 is a mechanical pump, which is driven by the rotation of the crankshaft of the engine. During the rotation of the pump 4, the hydraulic oil is continuously supplied from the pump 4 to the supply passage 40. The hydraulic oil can be drained from the drain passages 41 into the drain pan (serving as a drain recovery storage) 5, and the drain passages 41 and the drain pan 5 are both open to the atmosphere. Each of the advancing passages 42 is communicated with a corresponding one of the advancing chambers 22. Each of the retarding passages 43 is communicated with a corresponding one of the retarding chambers 23.

The control valve 50 is a solenoid spool valve, which includes a spool 53 that is received in a sleeve 54 and is reciprocated in the sleeve 54 by a drive force generated from a solenoid 51 upon energization thereof and a restoring force generated by a spring 52. Supply ports 60, drain ports 61, advancing ports (also referred to as feed ports) 62 and retarding ports (also referred to as feed ports) 63 are formed in the sleeve 54 of the control valve 50. The supply ports 60 are communicated with the supply passage 40. The drain ports 61 are communicated with the drain passages 41. Furthermore, the advancing ports 62 are communicated with the advancing passages 42, and the retarding ports 63 are communicated with the retarding passages 43. At the control valve 50, an axial moving position (axial position), i.e., an operational position (hereinafter, also simply referred to as a spool position) of the spool 53 is changed in response to the energization of the solenoid 51 to change the connecting state of each of these ports 60-63.

The control circuit 90 is an electronic circuit, which includes, for example, a microcomputer as its main component. The control circuit 90 is electrically connected to the control valve 50, the solenoid 51 and the various electric components (not shown) of the engine. The control circuit 90 controls the energization of the solenoid 51 and the rotation of the engine through a computer program stored in an internal memory of the control circuit 90.

Next, an oscillating torque applied to the vane rotor 15 will be described.

Figure 5:
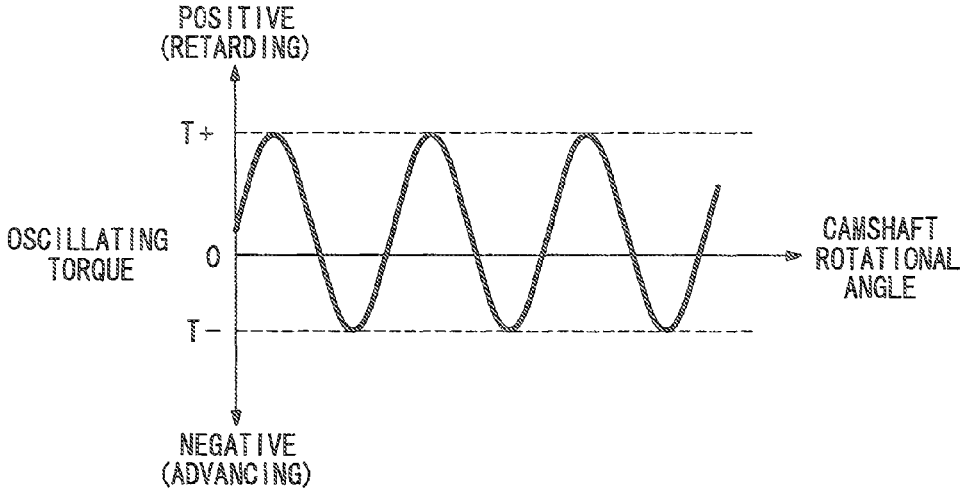
FIG. 5 is a diagram showing an oscillating torque exerted in the valve timing control apparatus of the embodiment.

During the rotation of the engine, the oscillating torque is generated at the camshaft 2 due to a spring reaction force applied from the intake valves, which are opened or closed by the camshaft 2. This oscillating torque is transmitted to the vane rotor 15 of the drive device 10 through the camshaft 2. As shown in FIG. 5, the oscillating torque is an alternating torque that changes between a negative torque, which is exerted to the vane rotor 15 in an advancing direction relative to the housing 11, and a positive torque, which is exerted to the vane rotor 15 in a retarding direction relative to the housing 11.

An absolute value of a peak (peak torque) T+ of the positive torque may be larger than an absolute value of a peak (peak torque) T− of the negative torque, so that the average (average torque) of the oscillating torque may be biased on the positive torque side. Alternatively, the absolute value of the peak T+ of the positive torque may be substantially equal to the absolute value of the peak T− of the negative torque, so that the average (average torque) may become substantially zero.

Next, the detail of the structure of the valve timing control apparatus 1 will be described.

As shown in FIGS. 1 and 2, the camshaft 2 coaxially extends through the vane rotor 15 from the rear plate 14 side to the front plate 13 side. A projecting portion 2*a* of the camshaft 2, which projects from the front plate 13, is supported by a bearing 6 of the engine. The camshaft 2 includes an axial hole 2*b*, which is configured into a cylindrical hole and opens in an end surface of the projecting portion 2*a*. The sleeve 54, which is configured into a cylindrical tubular form, is coaxially inserted into the axial hole 2*b*, so that the portion of the control valve 50 is received in the camshaft 2 on a radially inner side of the vane rotor 15.

In the present embodiment, a fixing portion 2*c* of the camshaft 2 made of metal is located on a rear plate 14 side of the projecting portion 2*a* and is securely press fitted into the rotatable shaft 15*a* of the vane rotor 15 made of metal. Furthermore, the spool 53 made of metal and the spring 52 made of metal are received in the sleeve 54 made of metal, and the sleeve 54 is threadably fixed to the hole 2*b* of the camshaft 2. Since the sleeve 54 is fixed in the above describe manner, the sleeve 54 is rotated integrally with the camshaft 2 and the vane rotor 15, which forms a synchronously rotatable member 17, and also with the spool 53 and the spring 52, which form the received member. Therefore, the spool 53 is slidably rotatable relative to a drive shaft 51*a* of the solenoid 51, which is installed to a stationary member (e.g., a chain cover) of the engine and drives the spool 53 to reciprocate the spool 53 along the axis.

Figure 6:
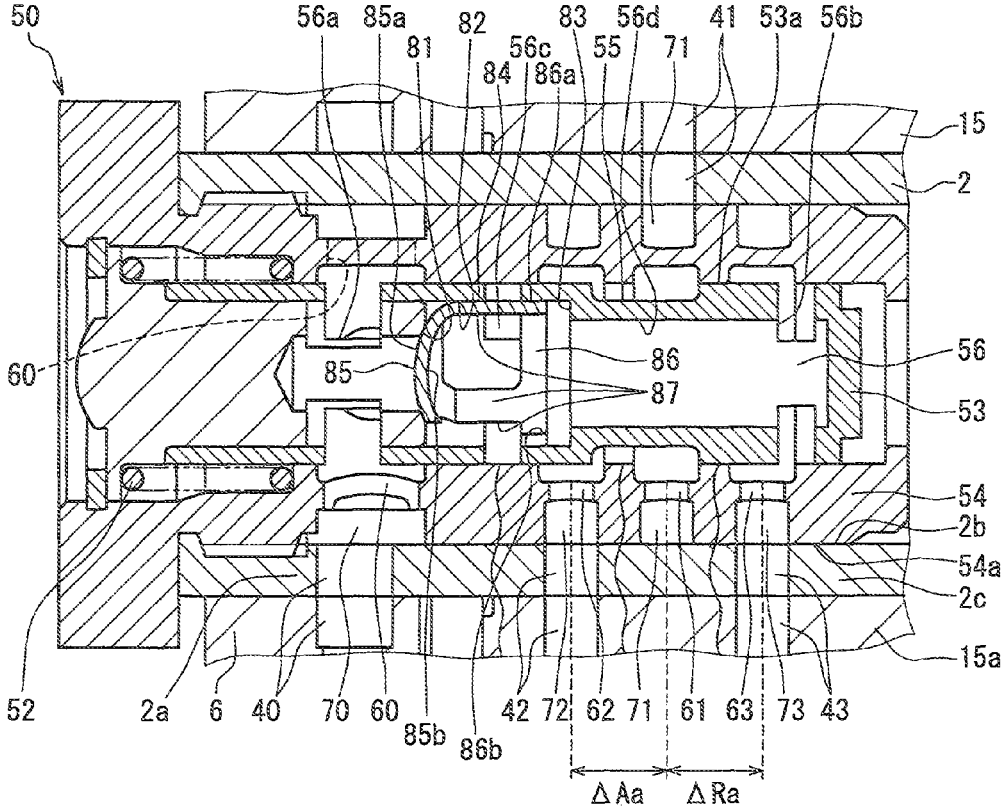
FIG. 6 is a partial enlarged cross-sectional view, showing a control valve of the valve timing control apparatus shown in FIG. 1.

The sleeve 54 of the control valve 50 includes the ports 60-63, each of which is provided in the predetermined corresponding number. As shown in FIG. 6, the supply ports 60 are arranged one after another at predetermined intervals in a circumferential direction of the sleeve 54. Each supply port 60 is communicated with the supply passage 40 (see also FIG. 1), which extends through the projecting portion 2*a* of the camshaft 2 and the bearing 6, through a supply opening 70, which is configured as an annular groove that opens in the outer peripheral surface 54*a* of the sleeve 54.

As shown in FIGS. 2 and 6, in the sleeve 54, the drain ports 61 are placed at an axial location, which is displaced from the supply ports 60 in the axial direction of the sleeve 54, such that the drain ports 61 are arranged one after another at predetermined intervals in the circumferential direction of the sleeve 54. Each drain port 61 is communicated with the drain passages 41 (see also FIG. 1), which extend through the projecting portion 2*a* of the camshaft 2 and the bearing 6, through a drain opening 71, which is configured as an annular groove that opens in the outer peripheral surface 54*a* of the sleeve 54. In the present embodiment, the drain passages 41 are located on the radially outer side of the drain ports 61, and each of the drain ports 61 is displaced from all of the drain passages 41 in the circumferential direction of the sleeve 54.

Figure 3:
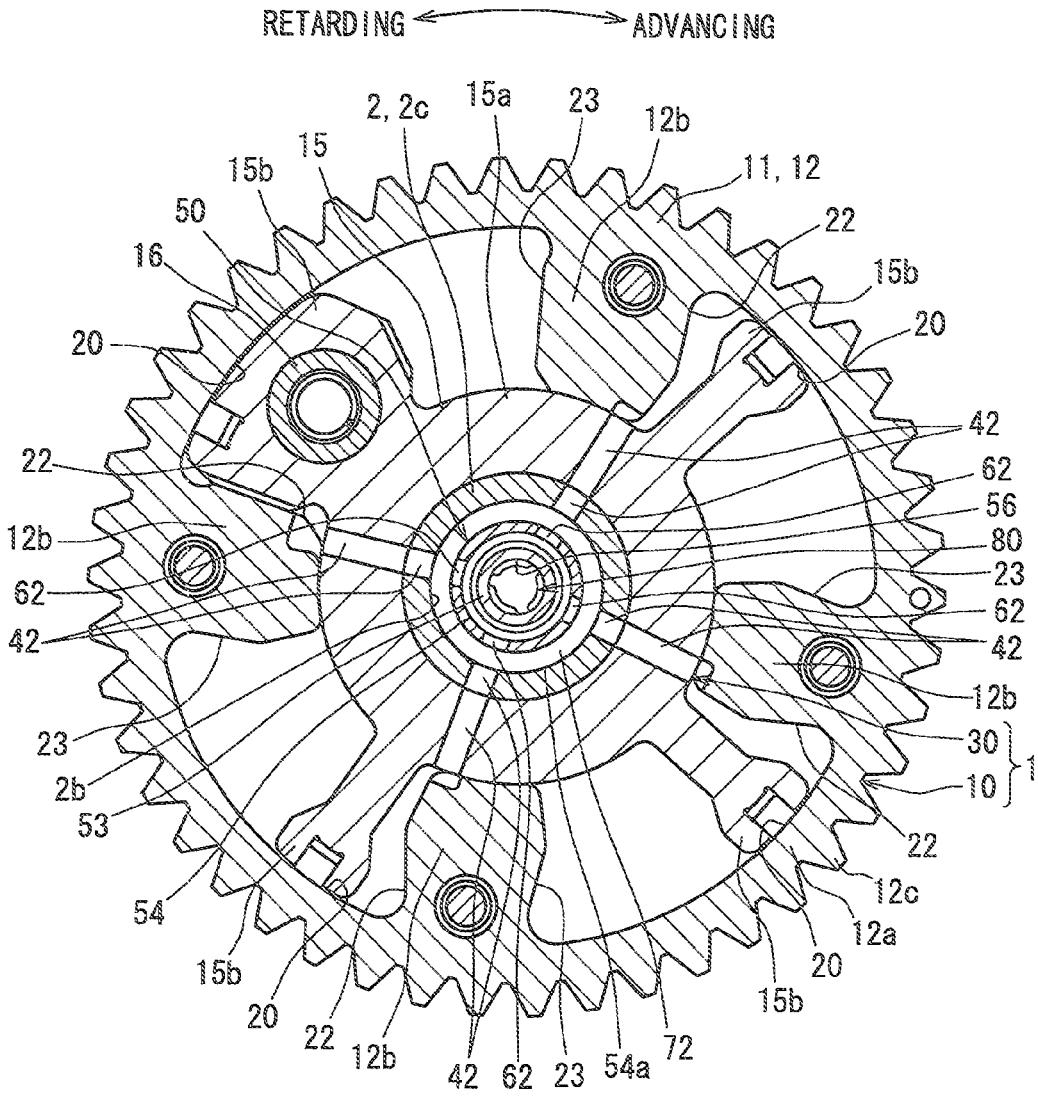
FIG. 3 is a cross sectional view taken along line III-III in FIG. 1.

As shown in FIGS. 3 and 6, the advancing ports 62 are placed at an axial location, which is displaced from the drain ports 61 in the axial direction of the sleeve 54, such that the advancing ports 62 are arranged one after another at predetermined intervals in the circumferential direction of the sleeve 54. Each advancing port 62 is communicated with the advancing passages 42 (see also FIG. 1), which extend through the fixing portion 2*c* of the camshaft 2 and the rotatable shaft 15*a* of the vane rotor 15 and are respectively configured as a hole, through an advancing opening 72, which is configured as an annular groove that opens in the outer peripheral surface 54*a* of the sleeve 54. In the present embodiment, the advancing passages 42 are located on the radially outer side of the advancing ports 62, and each of the advancing ports 62 is placed in the circumferential direction of the sleeve 54 at a corresponding circumferential position, which coincides with a circumferential position of the corresponding one of the advancing passages 42. Thereby, each of the advancing ports 62 and the corresponding advancing passage 42 are located along a corresponding imaginary radial line.

Figure 4:
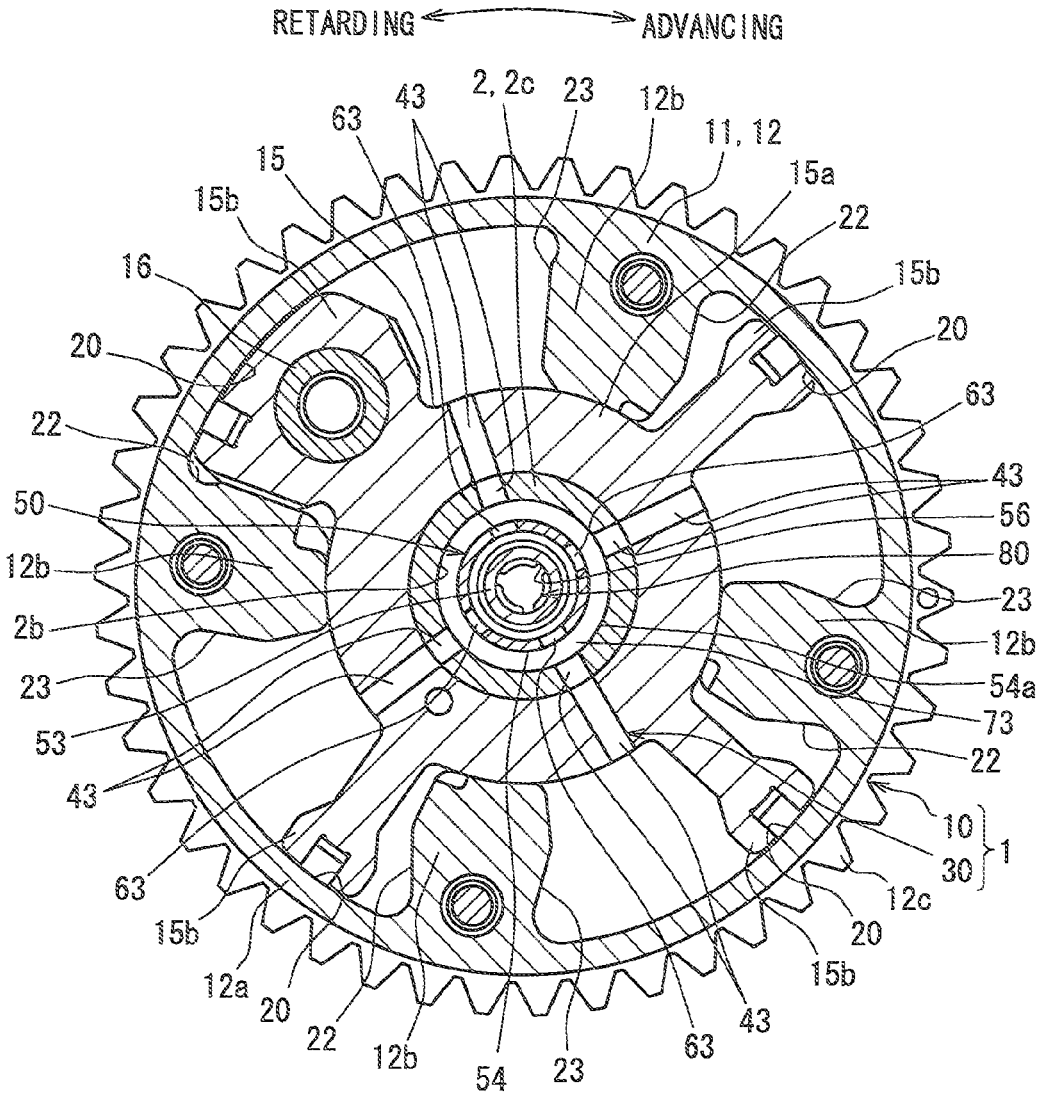
FIG. 4 is a cross sectional view taken along line IV-IV in FIG. 1.

As shown in FIGS. 4 and 6, the retarding ports 63 are placed at an axial location, which is displaced from the drain ports 61 in the axial direction of the sleeve 54 on an axial side of the drain ports 61 that is opposite from the advancing ports 62, such that the retarding ports 63 are arranged one after another at predetermined intervals in the circumferential direction of the sleeve 54. Each retarding port 63 is communicated with the retarding passages 43 (see also FIG. 1), which extend through the fixing portion 2*c* of the camshaft 2 and the rotatable shaft 15*a* of the vane rotor 15 and are respectively configured as a hole, through a retarding opening 73, which is configured as an annular groove that opens in the outer peripheral surface 54*a* of the sleeve 54.

In the present embodiment, with reference to FIG. 6, the axial location of each retarding port 63 and the axial location of each advancing port 62 are displaced from the axial location of each drain port 61 in the axial direction of the sleeve 54. Specifically, the amount of axial positional displacement ΔRa between the axial location of the retarding port 63 and the axial location of the drain port 61 is substantially the same as the amount of axial positional displacement ΔAa between the axial location of the advancing port 62 and the axial location of the drain port 61. The retarding passages 43 are located on the radially outer side of the retarding ports 63, and each of the retarding ports 63 is placed in the circumferential direction of the sleeve 54 at a corresponding circumferential position, which coincides with a circumferential position of a corresponding one of the retarding passages 43. Thereby, each of the retarding ports 63 and the corresponding retarding passage 43 are located along a corresponding imaginary radial line.

Figure 11:
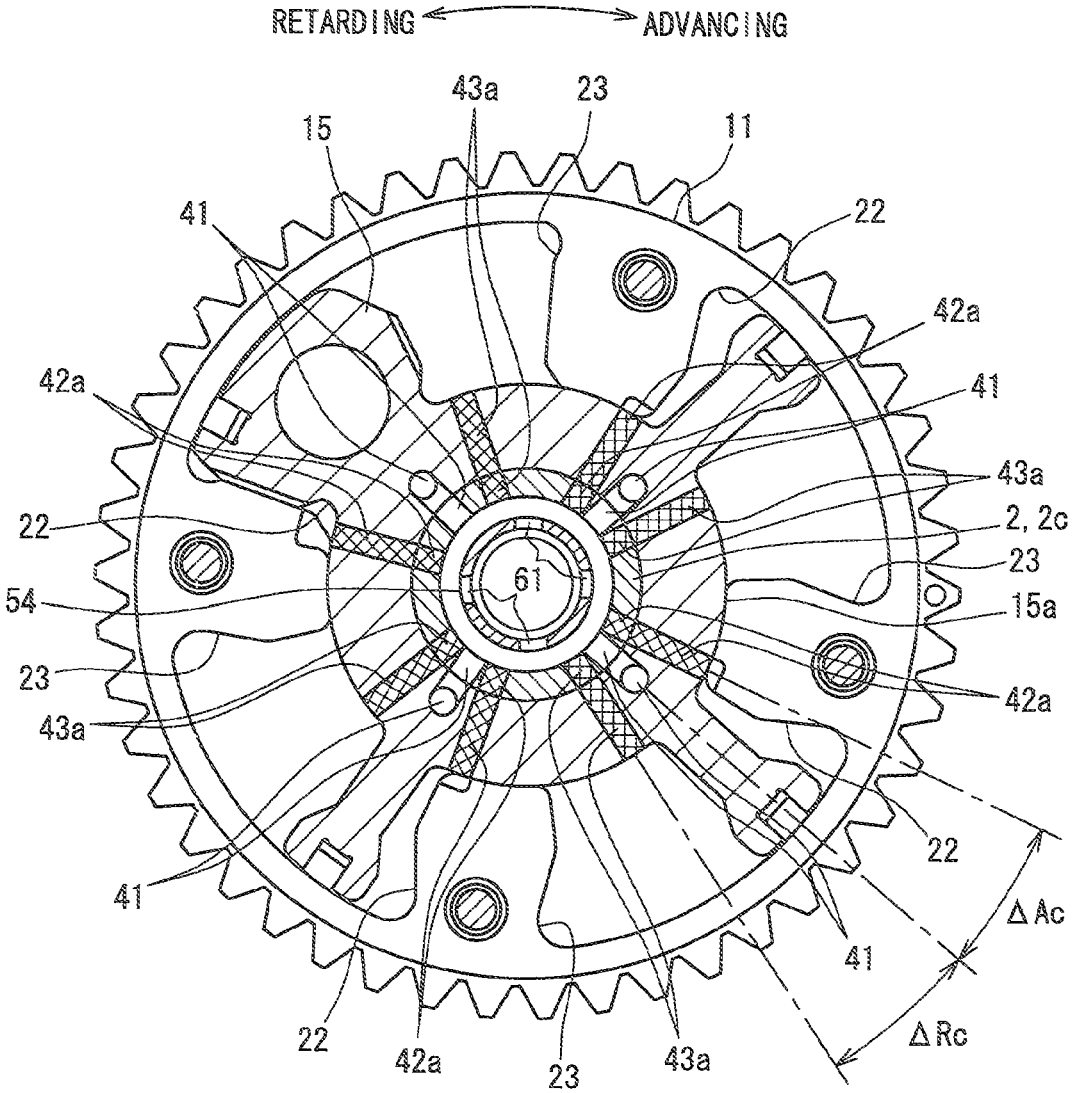
FIG. 11 is a schematic diagram for describing a feature of the control valve of the valve timing control apparatus shown in FIG. 1.

FIG. 11 is a schematic diagram indicating the positional relationships among the drain passages 41, the advancing passages 42 and the retarding passages 43. More specifically, FIG. 11 shows an axially projected shadow (axially projected area) 42*a* of each of the advancing passages 42, which is formed by axially projecting the advancing passage 42 on the drain passage 41 side, i.e., by axially projecting the advancing passage 42 on an imaginary plane that extends in a direction perpendicular to the axial direction of the sleeve 54 through the drain passages 41. FIG. 11 also shows an axially projected shadow (axially projected area) 43*a* of each of the retarding passages 43, which is formed by axially projecting the retarding passage 43 on the drain passage 41 side, i.e., by axially projecting the retarding passage 43 on the imaginary plane that extends in the direction perpendicular to the axial direction of the sleeve 54 through the drain passages 41. As shown in FIG. 11, the axially projected shadow 42*a* of each advancing passage 42 is located on one circumferential side of a corresponding one of the drain passages 41, and the axially projected shadow 43*a* of a corresponding one of the retarding passages 43 is located on the other circumferential side of this drain passage 41. Thereby, each drain passage 41 is circumferentially held between the axially projected shadow 42*a* of the corresponding advancing passage 42 and the axially projected shadow 43*a* of the corresponding retarding passage 43. In the present embodiment, the amount of circumferential positional displacement ΔAc between the axially projected shadow 42*a* of the advancing passage 42 and the drain passage 41 measured in the circumferential direction of the sleeve 54 is substantially the same as the amount of circumferential positional displacement ΔRc between the axially projected shadow 43*a* of the retarding passage 43 and the drain passage 41 measured in the circumferential direction of the sleeve 54.

In the control valve 50, as shown in FIG. 6, the spool 53 includes a communication passage 55 and a connection passage 56. The communication passage 55 is configured as an annular groove that opens in the outer peripheral surface 53*a* of the spool 53. The connection passage 56 is configured as a cylindrical hole that has two end portions 56*a*, 56*b* and an intermediate portion 56*c* located therebetween, and the end portions 56*a*, 56*b* and the intermediate portion 56*c* of the connection passage 56 are opened to the outer peripheral surface 53*a* of the spool 53.

Figure 7A:
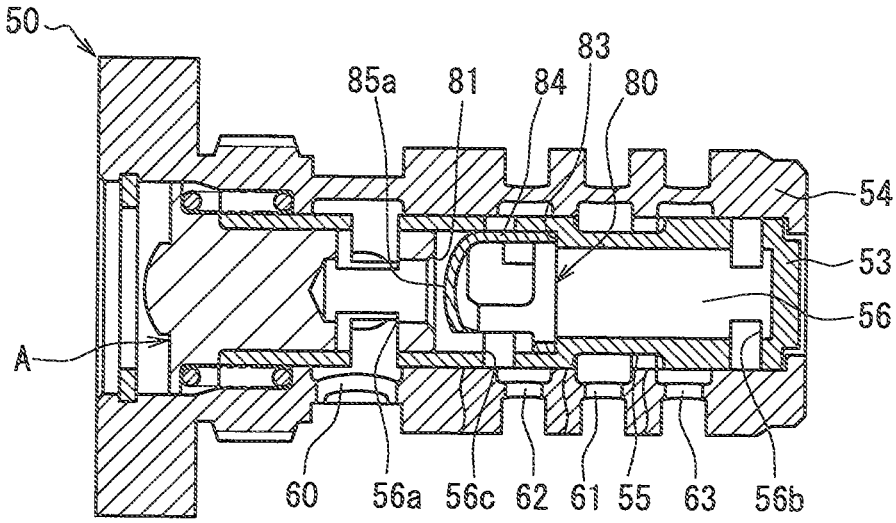
FIG. 7A is a schematic cross sectional view, showing a valve open state of the control valve of the embodiment in an advancing mode.
Figure 7B:
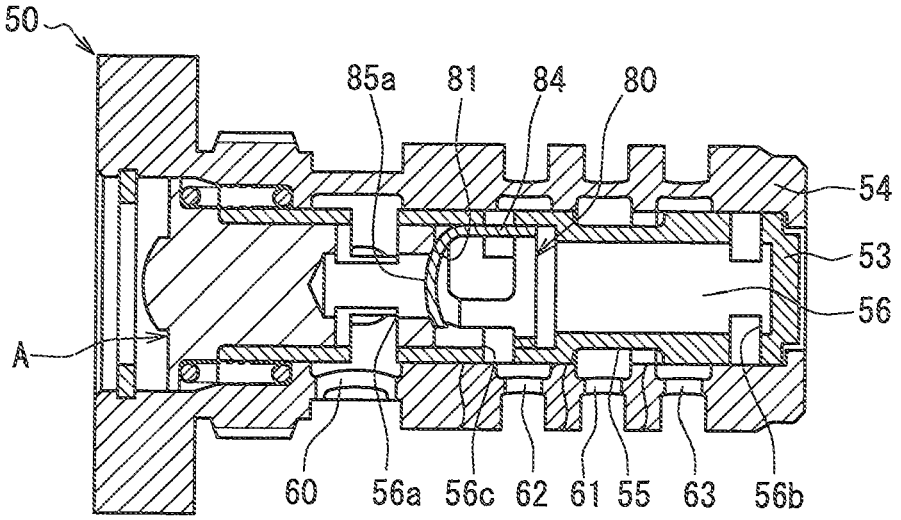
FIG. 7B is a schematic cross sectional view, showing a valve closed state of the control valve of the embodiment in the advancing mode.

With the above structure, at the operational position (axial position) of the spool 53 during the operation in the advancing mode A shown in FIGS. 7A and 7B, the communication passage 55 is connected to each drain port 61 and each retarding port 63. Also, at the operational position of the spool 53 during the operation in the advancing mode A shown in FIGS. 7A and 7B, the one end portion 56*a* of the connection passage 56 is connected to each supply port 60, and the intermediate portion 56*c* of the connection passage 56 is connected to each advancing port 62. Furthermore, the other end portion 56*b* of the connection passage 56 is closed by the sleeve 54.

Figure 8A:
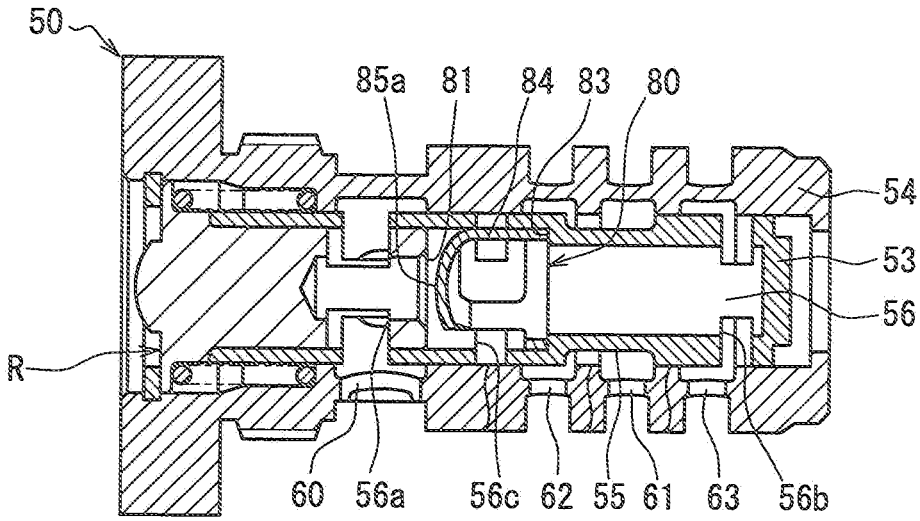
FIG. 8A is a schematic cross sectional view, showing a valve open state of the control valve of the embodiment in a retarding mode.
Figure 8B:
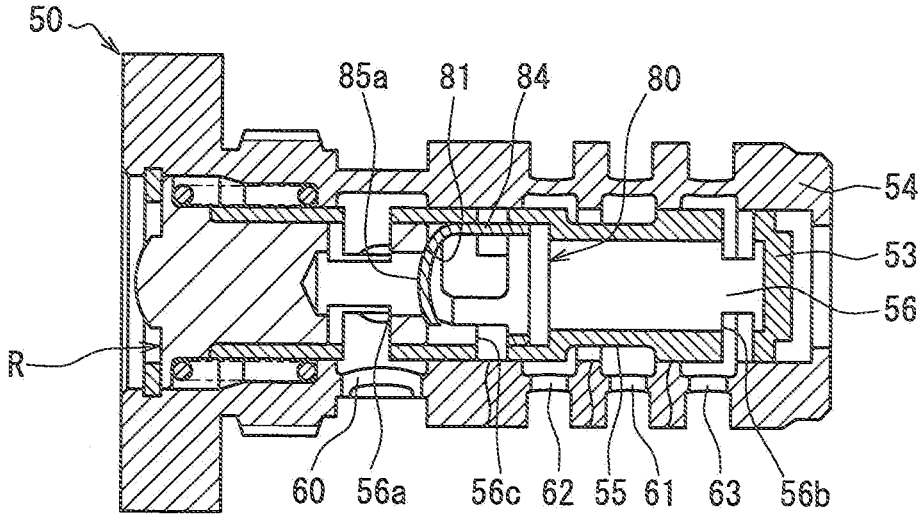
FIG. 8B is a schematic cross sectional view, showing a valve closed state of the control valve of the embodiment in the retarding mode.

In contrast, at the operational position of the spool 53 during the operation in the retarding mode R shown in FIGS. 8A and 8B, the communication passage 55 is connected to each drain port 61 and each advancing port 62. Also, at the operational position of the spool 53 during the operation in the retarding mode R, the one end portion 56*a* of the connection passage 56 is connected to each supply port 60, and the intermediate portion 56*c* of the connection passage 56 is closed by the sleeve 54. Furthermore, the other end portion 56*b* of the connection passage 56 is connected to each retarding port 63.

In the control valve 50, as shown in FIGS. 1 to 4, a check valve 80 is installed in the connection passage 56 of the spool 53. As shown in FIG. 6, in the present embodiment, the check valve 80 is a springless check valve and includes a valve seat 81, a guide 82, a stopper 83 and a valve member 84.

The valve seat 81 is formed by a tapered surface (conical surface), which is formed by a wall surface 56*d* of the connection passage 56 and has a progressively reducing diameter that is axially progressively reduced toward the one end portion 56*a* of the connection passage 56. The guide 82 is formed by a cylindrical surface of the wall surface 56*d* of the connection passage 56, which forms the intermediate portion 56*c* and is located on an axial side of the valve seat 81 where the other end portion 56*b* is located. The stopper 83 is formed by a step surface of the wall surface 56*d* of the connection passage 56, which is axially opposed to the valve seat 81 and is located on an axial side of the guide 82 where the other end portion 56*b* is located. The valve member 84 is made of metal and is configured into a cylindrical tubular body having a bottom. The valve member 84 is received in the intermediate portion 56*c* of the connection passage 56 at a location radially inward of the guide 82, such that the valve member 84 is adapted to reciprocate in the axial direction.

In the present embodiment, the valve member 84 is formed by processing a metal plate through, for example, a press working process. As shown in FIGS. 6 and 9A to 9C, the valve member 84 includes a spherical plate portion 85, an annular ring portion 86 and a plurality (three in this instance) of bridge portions 87. The spherical plate portion 85 forms an axial end portion of the valve member 84 at the bottom side of the valve member 84. The spherical plate portion 85 includes a convex plate surface (bottom surface) 85*a* and a concave plate surface 85*b*, which are axially opposed to each other. The convex plate surface 85*a* is a partial spherical surface that is convex toward the valve seat 81. The concave plate surface 85*b* is a partial spherical surface that is concave toward the convex plate surface 85*a*. The convex plate surface 85*a* and the concave plate surface 85*b* have circular outer peripheral edges, respectively, which are coaxial with each other. A thickness of the spherical plate portion 85, which is measured between the convex plate surface 85*a* and the concave plate surface 85*b*, is substantially uniform throughout the spherical plate portion 85. In the present embodiment, the convex plate surface 85*a* is adapted to seat against the valve seat 81, which is coaxial with the convex plate surface 85*a*, such that the convex plate surface 85*a* makes line contact with the conical surface of the valve seat 81.

As shown in FIGS. 6 and 9A to 9C, the annular ring portion 86 forms an axial end portion of the valve member 84 at an opening side of the valve member 84, which is opposite from the bottom side of the valve member 84. The annular ring portion 86 includes an outer peripheral surface 86*a* and an inner peripheral surface 86*b*. The outer peripheral surface 86*a* of the annular ring portion 86 is a cylindrical surface that is guided by the guide 82 such that the outer peripheral surface 86*a* is axially slidable along the guide 82. The inner peripheral surface 86*b* of the annular ring portion 86 is a cylindrical surface that has a diameter smaller than that of the outer peripheral surface 86*a*. A thickness of the annular ring portion 86, which is measured between the outer peripheral surface 86*a* and the inner peripheral surface 86*b*, is substantially uniform throughout the annular ring portion 86 and is substantially the same as that of the spherical plate portion 85. In the annular ring portion 86 of the present embodiment, the diameter of the inner peripheral surface 86*b*, which is coaxial with the spherical plate portion 85 having the circular outer peripheral edge, is made larger than the diameter of the spherical plate portion 85. Therefore, as shown in FIG. 10, the inner peripheral surface 86*b* is located on a radially outer side of an axially projected shadow, i.e., an axially projected area 85*c* (see a cross-hatching shown in FIG. 10) of the spherical plate portion 85, which is axially projected on the annular ring portion 86 side, i.e., is axially projected on an imaginary plane that extends in a direction perpendicular to the axial direction of the valve member 84 through the annular ring portion 86.

Figure 9A:
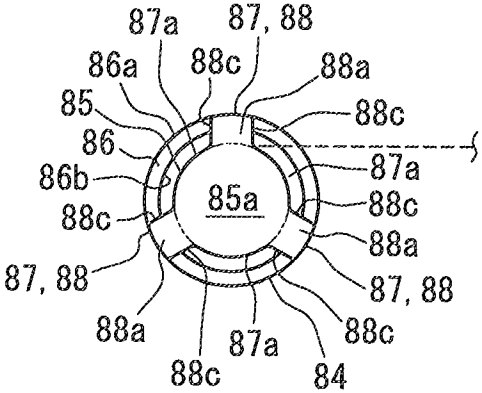
FIG. 9A is a bottom view of a check valve of the control valve shown in FIG. 6.
Figure 9B:
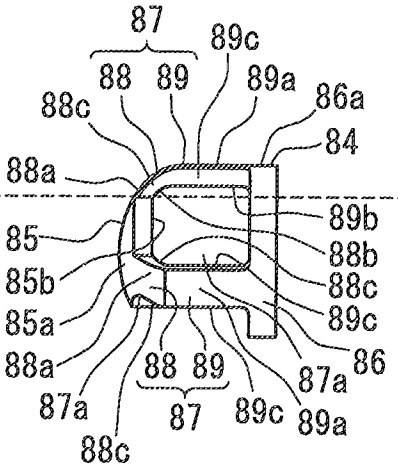
FIG. 9B is a side view of the check valve shown in FIG. 9A.
Figure 9C:
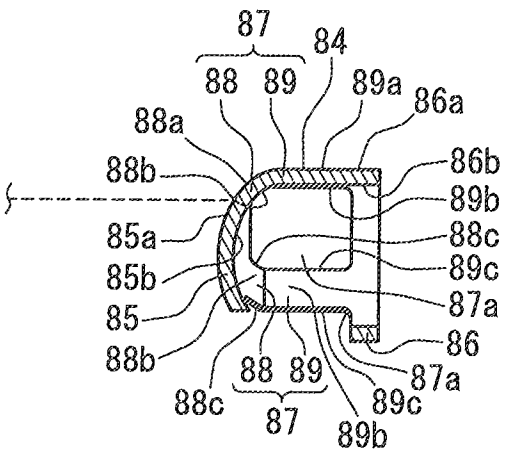
FIG. 9C is a cross-sectional view of the check valve shown in FIGS. 9A and 9B.
Figure 10:
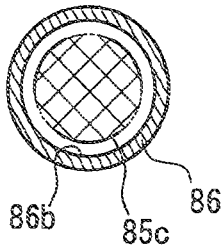
FIG. 10 is a schematic view showing a feature of the check valve of the embodiment.

As shown in FIGS. 6 and 9A to 9C, the three bridge portions 87, which form an axial intermediate portion of the valve member 84, are spaced from each other in the circumferential direction, i.e., are arranged one after another at generally equal intervals in the circumferential direction that is also the circumferential direction of the spherical plate portion 85 and the annular ring portion 86, such that the bridge portions 87 coaxially connect the spherical plate portion 85 to the annular ring portion 86. As shown in FIGS. 9A to 9C, each bridge portion 87 includes a first bridge plate portion 88 and a second bridge plate portion 89, which are continuously formed one after another in the axial direction. The first bridge plate portion 88 is located adjacent to the spherical plate portion 85 in the axial direction, and the second bridge plate portion 89 is located adjacent to the annular ring portion 86 in the axial direction.

The first bridge plate portion 88 includes an outer peripheral surface 88*a* and an inner peripheral surface 88*b*, which are opposed to each other. The outer peripheral surface 88*a* is continuous from the convex plate surface 85*a* of the spherical plate portion 85 and is formed as a partial spherical surface. The inner peripheral surface 88*b* is continuous from the concave plate surface 85*b* of the spherical plate portion 85 and is formed as a partial spherical surface. A radius of curvature of the outer peripheral surface 88*a* and a radius of curvature of the inner peripheral surface 88*b* are substantially the same as the radius of curvature of the convex plate surface 85*a* and the radius of curvature of the concave plate surface 85*b*, respectively. Therefore, a thickness of the first bridge plate portion 88, which is measured between the outer peripheral surface 88*a* and the inner peripheral surface 88*b*, is substantially uniform throughout the first bridge plate portion 88 and is substantially the same as the thickness of the spherical plate portion 85.

The second bridge plate portion 89 includes an outer peripheral surface 89*a* and an inner peripheral surface 89*b*. The outer peripheral surface 89*a* is continuous from the outer peripheral surface 86*a* of the annular ring portion 86 and is formed as a partial cylindrical surface. The inner peripheral surface 89*b* is continuous from the inner peripheral surface 86*b* of the annular ring portion 86 and is formed as a partial cylindrical surface. A diameter of the outer peripheral surface (more specifically, a diameter of an imaginary circle, along which the outer peripheral surface extends in the circumferential direction) 89*a* and a diameter of the inner peripheral surface (more specifically, a diameter of an imaginary circle, along which the inner peripheral surface extends in the circumferential direction) 89*b* are substantially the same as the diameter of the outer peripheral surface 86*a* and the diameter of the inner peripheral surface 86*b*, respectively. Therefore, a thickness of the second bridge plate portion 89, which is measured between the outer peripheral surface 89*a* and the inner peripheral surface 89*b*, is substantially uniform throughout the second bridge plate portion 89 and is substantially the same as that of the annular ring portion 86 (i.e., the thickness of the second bridge plate portion 89 being substantially the same as that of the spherical plate portion 85).

A circumferential side lateral surface 88*c* of the first bridge plate portion 88 and a circumferential side lateral surface 89*c* of the second bridge plate portion 89 are continuous one after another in the axial direction to form a planar continuous surface that is continuous in the axial direction. A slit 87*a* is circumferentially defined between the lateral surfaces 88*c*, 89*c* of one of each adjacent two of the bridge portions 87 and the lateral surfaces 88*c*, 89*c* of the other one of each adjacent two of the bridge portions 87 to axially extend from an outer peripheral side of the spherical plate portion 85 to the annular ring portion 86.

The check valve 80, which has the above structure, is operated in response to a pressure relationship, i.e., a pressure difference between a pressure on the one end portion 56*a* side of the valve seat 81 and a pressure on the other end portion 56*b* side of the valve seat 81 in the connection passage 56. Specifically, when the pressure on the one end portion 56*a* side of the valve seat 81 becomes higher than the pressure on the other end portion 56*b* side of the valve seat 81 in the connection passage 56, the valve member 84 is moved toward the other end portion 56*b* side in the connection passage 56 until the valve member 84 abuts against the stopper 83, as shown in FIGS. 7A and 8A, so that the convex plate surface 85*a* is lifted away from the valve seat 81, and thereby the check valve 80 is opened. Thus, in the connection passage 56, during the operation in the advancing mode A shown in FIG. 7A, the flow of the hydraulic oil from each supply port 60 to each advancing port 62 side is enabled by the opening of the check valve 80. Furthermore, in the connection passage 56, during the operation in the retarding mode R shown in FIG. 8A, the flow of the hydraulic oil from each supply port 60 to each retarding port 63 side is enabled by the opening of the check valve 80.

In contrast, when the pressure on the other end portion 56*b* side of the valve seat 81 becomes higher than the pressure on the one end portion 56*a* side of the valve seat 81 in the connection passage 56, the valve member 84 is moved toward the one end portion 56*a* side in the connection passage 56, and thereby the convex plate surface 85*a* is seated against the valve seat 81, as shown in FIGS. 7B and 8B. Thereby, the check valve 80 is closed. Thus, in the connection passage 56 during the operation in the advancing mode A shown in FIG. 7B, the flow of the hydraulic oil from each advancing port 62 to each supply port 60 side is limited by the closing of the check valve 80. Furthermore, in the connection passage 56 during the operation in the retarding mode R shown in FIG. 8B, the flow of the hydraulic oil from each retarding port 63 to each supply port 60 side is limited by the closing of the check valve 80.

Next, the control operation (adjusting operation) of the valve timing with the valve timing control apparatus 1 will be described.

At the time of steady operation of the engine, in which the supply of the hydraulic oil from the pump 4 is maintained, the operational position of the spool 53 is selected by the control circuit 90 such that the control circuit 90 controls the energization of the solenoid 51 in a manner that implements the valve timing suitable for the operational state of the engine. Therefore, the input and output of the hydraulic oil relative to each advancing chamber 22 and each retarding chamber 23 are controlled in response to the selected operational position of the spool 53. The valve timing control operation for each of the advancing mode A and the retarding mode R at the time of steady operation of the engine will be described. At the time of starting the steady operation of the engine, each advancing chamber 22 is filled with the corresponding quantity of the hydraulic oil that corresponds to the volume of the advancing chamber 22, and each retarding chamber 23 is filled with the corresponding quantity of the hydraulic oil that corresponds to the volume of the retarding chamber 23.

(1) Advancing Mode A

At the time of the steady operation of the engine, when an operational condition, such as presence of an actual rotational phase on a retarding side of a target rotational phase beyond an allowable deviation, is satisfied, the operational position (axial position) of the spool 53 during the operation in the advancing mode A shown in FIGS. 7A and 7B is selected. At this operational position of the spool 53, each advancing port 62, which is communicated with each advancing chamber 22 through each advancing passage 42, is connected to each supply port 60, which is communicated with the supply passage 40, through the connection passage 56. At the same time, each retarding port 63, which is communicated with each retarding chamber 23 through each retarding passage 43, is connected to each drain port 61 that is opened to the atmosphere through the communication with each drain passage 41, through the communication passage 55.

In this connection state, when a negative torque, which increases the volume of each advancing chamber 22, is exerted, a negative pressure is generated in each advancing chamber 22. Thereby, in the connection passage 56, which is connected to each advancing chamber 22 through each advancing port 62, the check valve 80 is opened, as shown in FIG. 7A, and thereby the flow of the hydraulic oil toward each advancing port 62 is enabled. Thus, the hydraulic oil, which is supplied from the pump 4 to each supply port 60, is guided from the connection passage 56 into each advancing chamber 22 through each advancing port 62. At the same time, the hydraulic oil of each retarding chamber 23 is discharged from each retarding port 63 into each drain passage 41 through the communication passage 55 and each drain port 61. As a result, the rotational phase is changed to the advancing side to advance the valve timing.

Furthermore, when the direction of the oscillating torque is reversed to exert the positive torque, which reduces the volume of each advancing chamber 22, the hydraulic oil of each advancing chamber 22 is discharged into the connection passage 56 through each advancing port 62. In this way, in the connection passage 56, the check valve 80 is closed, as shown in FIG. 7B, and thereby the flow of the hydraulic oil from each advancing port 62 toward each supply port 60 is limited. As a result, the discharge of the hydraulic oil from each advancing chamber 22 is stopped, and thereby the returning of the rotational phase, which causes an increase in the volume of each retarding chamber 23 and thereby limits the discharge of the hydraulic oil into each drain passage 41, is limited regardless of the exertion of the positive torque.

(2) Retarding Mode R

At the time of the steady operation of the engine, when an operational condition, such as presence of the actual rotational phase on an advancing side of the target rotational phase beyond an allowable deviation, is satisfied, the operational position (axial position) of the spool 53 during the operation in the retarding mode R shown in FIGS. 8A and 8B is selected. At this operational position of the spool 53, each retarding port 63, which is communicated with each retarding chamber 23 through each retarding passage 43, is connected to each supply port 60, which is communicated with the supply passage 40, through the connection passage 56. At the same time, each advancing port 62, which is communicated with each advancing chamber 22 through each advancing passage 42, is connected to each drain port 61 that is opened to the atmosphere through the communication with each drain passage 41, through the communication passage 55.

In this connection state, when a positive torque, which increases the volume of each retarding chamber 23, is exerted, a negative pressure is generated in each retarding chamber 23. Thereby, in the connection passage 56, which is connected to each retarding chamber 23 through each retarding port 63, the check valve 80 is opened, as shown in FIG. 8A, and thereby the flow of the hydraulic oil toward each retarding port 63 is enabled. Thus, the hydraulic oil, which is supplied from the pump 4 to each supply port 60, is guided from the connection passage 56 into each retarding chamber 23 through each retarding port 63. At the same time, the hydraulic oil of each advancing chamber 22 is discharged from each advancing port 62 into each drain passage 41 through the communication passage 55 and each drain port 61. As a result, the rotational phase is changed to the retarding side to retard the valve timing.

Furthermore, when the direction of the oscillating torque is reversed to exert the negative torque, which reduces the volume of each retarding chamber 23, the hydraulic oil of each retarding chamber 23 is discharged into the connection passage 56 through each retarding port 63. In this way, in the connection passage 56, the check valve 80 is closed, as shown in FIG. 8B, and thereby the flow of the hydraulic oil from each retarding port 63 toward each supply port 60 is limited. As a result, the discharge of the hydraulic oil from each retarding chamber 23 is stopped, and thereby the returning of the rotational phase, which causes an increase in the volume of each advancing chamber 22 and thereby limits the discharge of the hydraulic oil into each drain passage 41, is limited regardless of the exertion of the negative torque.

Now, advantages of the present embodiment will be described.

In the check valve 80 of the valve timing control apparatus 1, a restoring force of a spring is not applied to the valve member 84. Therefore, the valve opening speed of the valve member 84 at the time of lifting the valve member 84 from the valve seat 81 and the valve closing speed of the valve member 84 at the time of seating the valve member 84 against the valve seat 81 depend on the pressure of the hydraulic oil. In the spherical plate portion 85 of the valve member 84, the convex plate surface 85*a*, which is lifted away from or is seated against the valve seat 81, and the concave plate surface 85*b*, which is located on the opposite side of the convex plate surface 85*a*, are formed as the partial spherical surfaces, each having the circular outer peripheral edge. Therefore, a sufficient surface area of each of the convex plate surface 85*a* and the concave plate surface 85*b* is provided to effectively receive the pressure of the hydraulic oil. With these pressure receiving actions of the convex plate surface 85*a* and the concave plate surface 85*b*, the valve opening speed is increased to rapidly change the rotational phase, and the valve closing speed is increased to rapidly limit the returning of the rotational phase. Therefore, it is possible to improve the response speed for adjusting the valve timing, which corresponds to the rotational phase.

Furthermore, in the valve member 84 of the valve timing control apparatus 1, the annular ring portion 86 has the inner peripheral surface 86*b*, which is opposite from the outer peripheral surface 86*a* that is guided by the guide 82, and the diameter of the inner peripheral surface 86*b* is made larger than that of the spherical plate portion 85. Furthermore, the annular ring portion 86 is coaxially connected to the spherical plate portion 85 through the three bridge portions 87, each two of which are circumferentially spaced from each other by the corresponding slit 87*a*. With the above construction, a portion of the hydraulic oil, which flows through the connection passage 56 in the lifted state of the valve member 84 away from the valve seat 81, flows from the radially outer side of the circular outer peripheral edge of the spherical plate portion 85 into the slits 87*a*, each of which is circumferentially defined between the adjacent two of the bridge portions 87. Then, this portion of the hydraulic oil, which flows into the slits 87*a*, passes through the inside of the annular ring portion 86, which has the diameter larger than that of the circular outer peripheral edge of the spherical plate portion 85, without substantial collision against the valve member 84. Here, the annular ring portion 86 is located on the radially outer side of the axially projected shadow 85*c* of the spherical plate portion 85, which is axially projected toward the annular ring portion 86 side. This annular ring portion 86 enables the effective limitation of the collision of the hydraulic oil, which passes from the radially outer side of the spherical plate portion 85 into the slits 87*a*, against the valve member 84, so that the amount of pressure loss of the hydraulic oil can be sufficiently reduced. Thereby, in each of the advancing mode A and the retarding mode R, the supply of the hydraulic oil to each advancing chamber 22 or each retarding chamber 23 through each advancing port 62 or each retarding port 63 can be rapidly performed to reliably implement the rapid change in the rotational phase, so that it is possible to improve the response speed for adjusting the valve timing, which corresponds to the rotational phase.

Furthermore, in the valve member 84 of the valve timing control apparatus 1, each of the outer peripheral surface 88*a* and the inner peripheral surface 88*b* of the first bridge plate portion 88 of each bridge portion 87, is formed as the partial spherical surface, which is continuous from the corresponding one of the convex plate surface 85*a* and the concave plate surface 85*b* of the spherical plate portion 85. Therefore, the pressure of the hydraulic oil can be easily received with each of the outer peripheral surface 88*a* and the inner peripheral surface 88*b* of the first bridge plate portion 88 of each bridge portion 87 in corporation with the corresponding one of the convex plate surface 85*a* and the concave plate surface 85*b* of the spherical plate portion 85. Furthermore, in the second bridge plate portion 89 of each bridge portion 87, the outer peripheral surface 89*a*, which is formed as the partial cylindrical surface that is continuous from the outer peripheral surface 86*a* of the annular ring portion 86, can be guided by the guiding function of the guide 82, and the inner peripheral surface 89*b*, which is formed as the partial cylindrical surface that is continuous from the inner peripheral surface 86*b* of the annular ring portion 86, can perform the guiding function for guiding the hydraulic oil. The guiding function of the inner peripheral surface 89*b* of the second bridge plate portion 89 for guiding the hydraulic oil will not likely interfere with the flow of the hydraulic oil, which passes from the radially outer side of the spherical plate portion 85 into the slits 87*a* and then flows through the inside of the annular ring portion 86 in the lifted state of the valve member 84 away from the valve seat 81. Thereby, both of the rapid change in the rotational phase and the rapid limitation of the returning of the rotational phase are implemented, and thereby it is possible to improve the response speed for adjusting the valve timing.

Furthermore, in the valve member 84 of the valve timing control apparatus 1, the circumferential side lateral surface 88*c* of the first bridge plate portion 88 and the circumferential side lateral surface 89*c* of the second bridge plate portion 89 are continuously formed one after another in the axial direction as the continuous planar surface in each bridge portion 87, so that the circumferential side lateral surface 88*c* and the circumferential lateral surface 89*c* can cooperate with each other to effectively guide the hydraulic oil in the axial direction. The hydraulic oil, which passes from the radially outer side of the spherical plate portion 85 into the slits 87*a* in the lifted state of the valve member 84 away from the valve seat 81, is easily directed toward the inside of the annular ring portion 86 located on the downstream side of the slits 87*a* in the axial direction, so that the amount of pressure loss can be sufficiently reduced. Thereby, the rapid change in the rotational phase can be reliably implemented, and thereby it is possible to improve the response speed for adjusting the valve timing.

In the valve timing control apparatus 1, each drain port 61 is axially displaced from each advancing port 62 on one axial side thereof in the axial direction of the sleeve 54 and is also axially displaced from each retarding port 63 on the other axial side thereof in the axial direction of the sleeve 54.

Furthermore, each drain port 61 is circumferentially displaced from each drain passage 41 located on the radially outer side of the drain port 61 in the circumferential direction of the sleeve 54. Because of the above displacement of each drain port 61, the length of the passage, which serves as the discharge passage extending from each retarding port 63 or each advancing port 62 to each drain passage 41, becomes sufficient during the operation in the advancing mode A or the retarding mode R, and thereby the amount of pressure loss in this passage is advantageously increased (maximized). Thus, it is possible to limit the fluctuating movement of the vane rotor 15 that would be caused by the feeding of the air into one of each advancing chamber 22 and each retarding chamber 23, to which the hydraulic fluid is currently fed, upon the excessive discharging of the hydraulic oil during the operation in each of the advancing mode A and the retarding mode R. Thereby, the response speed for adjusting the valve timing, which corresponds to the rotational phase, can be improved.

Furthermore, in the valve timing control apparatus 1, each advancing port 62, which is communicated with each advancing chamber 22 through each advancing passage 42 formed as the through-hole in the synchronously rotatable member 17 (i.e., the camshaft 2 and the vane rotor 15), is formed such that the circumferential position of each advancing port 62 in the circumferential direction of the sleeve 54 coincides with the circumferential position of the corresponding advancing passage 42. Because of the above positional relationship of the advancing port 62, during the operation in the advancing mode A, the passage, which is now used as the feed passage extending from each advancing port 62 to each advancing passage 42, can implement the rapid feeding of the hydraulic oil by reducing the amount of pressure loss, and thereby it is possible to increase the response speed for adjusting the valve timing. In contrast, during the operation in the retarding mode R, the passage, which is now used as the discharge passage extending from each advancing passage 42 to each advancing port 62, causes the reduction in the amount of pressure loss. However, at this time, the amount of pressure loss can be increased in the passage, which is used as the discharge passage extending from each advancing port 62 to each drain passage 41. Thereby, it is possible to increase the response speed for adjusting the valve timing.

Furthermore, in the valve timing control apparatus 1, each retarding port 63, which is communicated with each retarding chamber 23 through each retarding passage 43 formed as the through-hole in the synchronously rotatable member 17 (i.e., the camshaft 2 and the vane rotor 15), is formed such that the circumferential position of each retarding port 63 in the circumferential direction of the sleeve 54 coincides with the circumferential position of the corresponding retarding passage 43. Because of the above positional relationship of the retarding port 63, during the operation in the retarding mode R, the passage, which is used as the feed passage extending from each retarding port 63 to each retarding passage 43, can implement the rapid feeding of the hydraulic oil by reducing the amount of pressure loss, and thereby it is possible to increase the response speed for adjusting the valve timing in the retarding mode R. In contrast, during the operation in the advancing mode A, the passage, which is now used as the discharge passage extending from each retarding passage 43 to each retarding port 63, causes the reduction in the amount of pressure loss. However, at this time, the amount of pressure loss can be increased in the passage, which is used as the discharge passage extending from each retarding port 63 to each drain passage 41. Thereby, it is possible to increase the response speed for adjusting the valve timing in the advancing mode A.

In addition, during the operation of the valve timing control apparatus 1 in each of the advancing mode A and the retarding mode R, the discharge passage is formed from the corresponding one of each retarding port 63 and each advancing port 62 to each drain passage 41 through each drain port 61, which is equally axially displaced from each of the retarding port 63 and the advancing port 62 in the axial direction of the sleeve 54 by the corresponding amount of axial positional displacement ΔRa, ΔAa. Furthermore, during the operation of the valve timing control apparatus 1 in each of the advancing mode A and the retarding mode R, the discharge passage is formed from the corresponding one of each retarding passage 43 and each advancing passage 42 to each drain passage 41, which is equally circumferentially displaced from each of the retarding passage 43 and the advancing passage 42 in the circumferential direction of the sleeve 54 by the corresponding amount of circumferential positional displacement ΔRc, ΔAc. With the above discharge passages, it is possible to reduce (minimize) the difference in the length of the discharge passage as well as the difference in the amount of pressure loss in the discharge passage at each of the advancing mode A and the retarding mode R. Therefore, the response speed can be increased in each of the advancing mode A and the retarding mode R.

Now, modifications of the above embodiment will be described.

The present invention has been described with respect to the one embodiment of the present invention. However, the present invention is not limited to the above embodiment, and the above embodiment may be modified in various ways within a spirit and scope of the present invention.

Figures 12A, 12B, 12C:
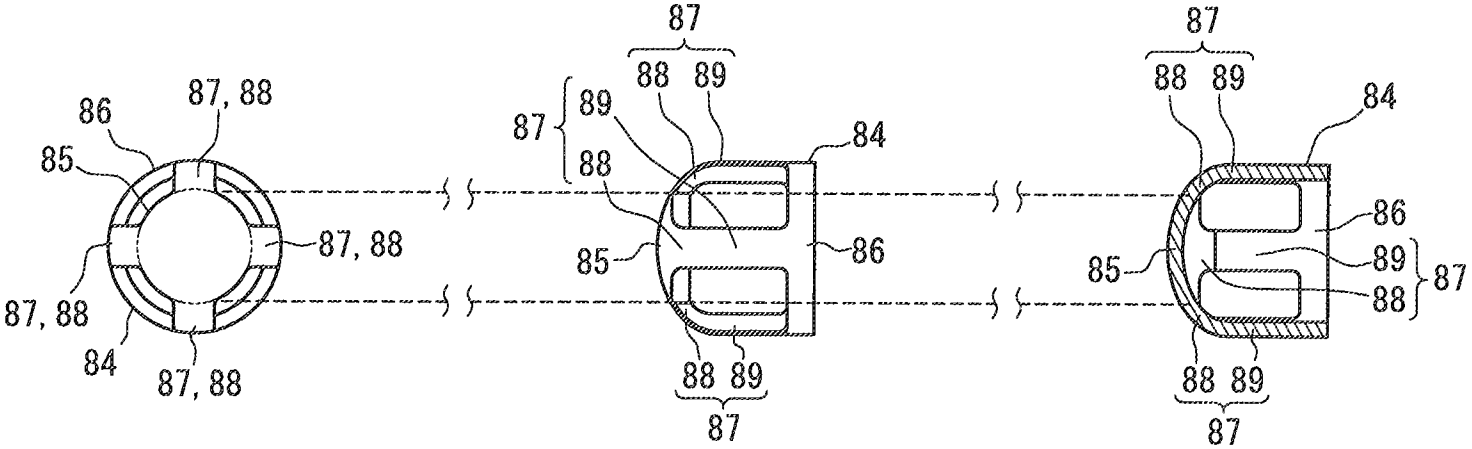
FIG. 12A is a bottom view of a check valve of a control valve in a modification of the embodiment.
FIG. 12B is a side view of the check valve shown in FIG. 12A.
FIG. 12C is a cross-sectional view of the check valve shown in FIGS. 12A and 12B.

Specifically, the bridge portions 87 may be other than the bridge portions 87, each of which has the first and second bridge plate portions 88, 89. For example, the bridge portions 87, each of which is tilted relative to the axial direction, may be used to connect between the spherical plate portion 85 and the annular ring portion 86, which have a diameter difference therebetween. Furthermore, the number of the bridge portions 87 may be changed to any other appropriate number. For example, as shown in FIGS. 12A to 12C, the number of the bridge portions 87 may be changed to four. Furthermore, in the control valve 50, at least a portion of the sleeve 54, which receives the spool 53 and the spring 52, may be directly received in the vane rotor 15. The present invention is also applicable to any other type of valve timing control apparatus, which controls valve timing of exhaust valves or which controls both of the valve timing of the intake valves and the valve timing of the exhaust valves.

Figure 13:
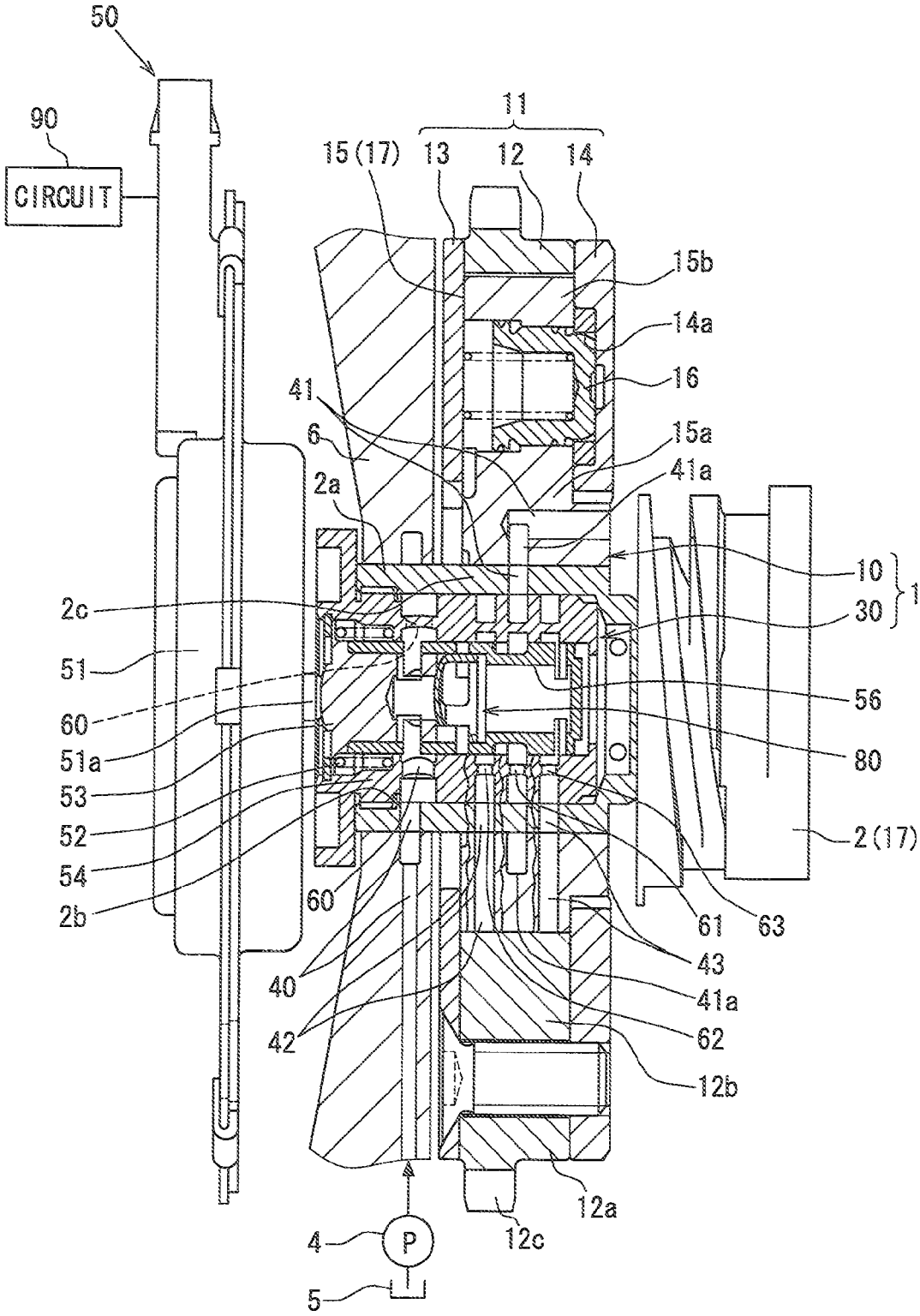
FIG. 13 is a cross sectional view, showing a modification of FIG. 1.
Figure 14:
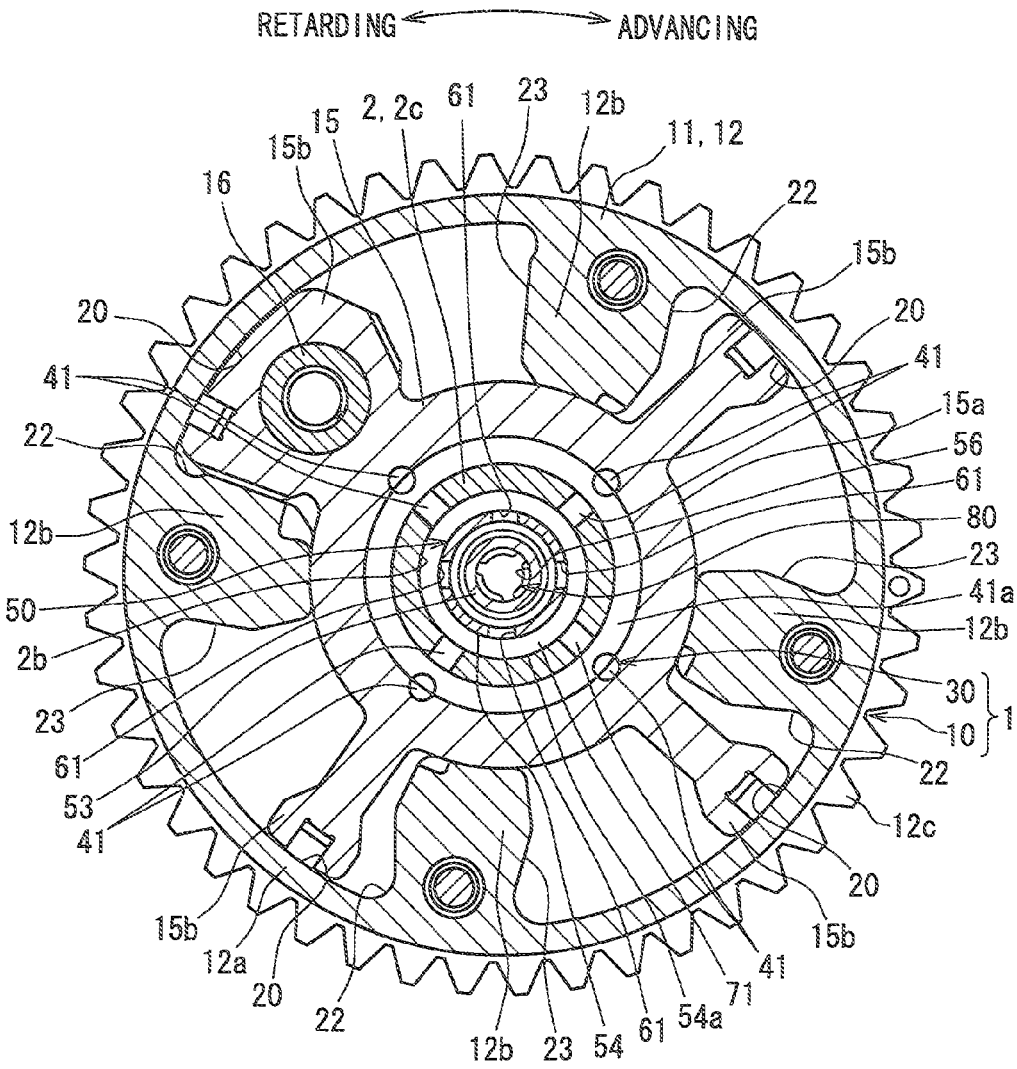
FIG. 14 is a cross sectional view, showing the modification shown in FIG. 13, indicating a cross-sectional view of the modification similar to that of FIG. 2.

The number of each of the above ports 60-63 is not limited to the above-described number and can be changed to one or can be increased further depending on a need. Furthermore, the amount of axial positional displacement ΔRa of the retarding port 63 from the drain port 61 in the axial direction of the sleeve 54 and the amount of axial positional displacement ΔAa of the advancing port 62 from the drain port 61 in the axial direction of the sleeve 54 may be set to be different from each other. Also, the amount of circumferential positional displacement ΔRc of the retarding passage 43 from the drain passage 41 in the circumferential direction of the sleeve 54 and the amount of circumferential positional displacement ΔAc of the advancing passage 42 from the drain passage 41 in the circumferential direction of the sleeve 54 may be set to be different from each other. Furthermore, as shown in FIGS. 13 and 14, which indicates a modification of the drain passages 41 of the above embodiment, an annular groove 41*a* may be formed between the portion of the camshaft 2, which is located on the side communicated with the drain ports 61, and the atmosphere communicated side (atmosphere open side) of the vane rotor 15, which is communicated with the atmosphere, such that the annular groove 41*a* opens in the inner peripheral surface of the vane rotor 15. In this way, the processing operation of the drain passages 41 at the time of manufacturing can be improved.

Additional advantages and modifications will readily occur to those skilled in the art. The invention in its broader terms is therefore not limited to the specific details, representative apparatus, and illustrative examples shown and described.

What is claimed is:

1. A valve timing control apparatus comprising:

a housing that is rotatable synchronously with a crankshaft of an internal combustion engine;

a vane rotor that is rotatable synchronously with a camshaft of the internal combustion engine, wherein the vane rotor partitions between an advancing chamber and a retarding chamber in a rotational direction in an inside of the housing, and a rotational phase of the vane rotor relative to the housing is changeable in one of an advancing side and a retarding side by feeding hydraulic fluid, which is supplied from a supply source, into a corresponding one of the advancing chamber and the retarding chamber; and a control valve that controls input and output of the hydraulic fluid relative to the advancing chamber and the retarding chamber, wherein:

valve timing of a valve, which is opened or closed by the camshaft, is adjusted by transmission of a torque from the crankshaft;

the control valve includes:

a supply port, to which the hydraulic fluid is supplied from the supply source during an operation in a phase change mode, which changes the rotational phase;

a feed port, through which the hydraulic fluid is fed to the one of the advancing chamber and the retarding chamber during the operation in the phase change mode;

a connection passage, which is connected to the supply port and the feed port during the operation in the phase change mode; and a springless check valve that enables flow of the hydraulic fluid from the supply port toward the feed port in the connection passage upon lifting of a valve member from a valve seat at the springless check valve during the operation in the phase change mode and limits flow of the hydraulic fluid from the feed port toward the supply port in the connection passage upon seating of the valve member against the valve seat during the operation in the phase change mode; and the valve member includes:

a spherical plate portion that includes a convex plate surface and a concave plate surface, which are opposed to each other and are configured into partial spherical surfaces, respectively, each having a circular outer peripheral edge, wherein the convex plate surface is seatable and liftable relative the valve seat;

an annular ring portion that includes:

an inner peripheral surface, which has a diameter larger than that of the spherical plate portion; and an outer peripheral surface, which is guided by a wall surface of the connection passage; and a plurality of bridge portions that are spaced from each other in a circumferential direction, wherein the plurality of bridge portions coaxially connects the annular ring portion to the spherical plate portion.

2. The valve timing control apparatus according to claim 1, wherein the annular ring portion is located radially outward of an axially projected shadow of the spherical plate portion, which is axially projected on the annular ring portion side.

3. The valve timing control apparatus according to claim 1, wherein each of the plurality of bridge portions includes:

a first bridge plate portion that includes:

an outer peripheral surface, which is formed as a partial spherical surface and is continuous from the convex plate surface of the spherical plate portion; and an inner peripheral surface, which is formed as a partial spherical surface and is continuous from the concave plate surface of the spherical plate portion; and a second bridge plate portion that includes:

an outer peripheral surface, which is formed as a partial cylindrical surface and is continuous from the outer peripheral surface of the annular ring portion; and an inner peripheral surface, which is formed as a partial cylindrical surface and is continuous from the inner peripheral surface of the annular ring portion.

4. The valve timing control apparatus according to claim 3, wherein each of the plurality of bridge portions is configured such that a circumferential side lateral surface of the first bridge plate portion and a circumferential side lateral surface of the second bridge plate portion form a planar continuous surface that is continuous in an axial direction.

5. A valve timing control apparatus comprising:

a housing that is rotatable synchronously with a crankshaft of an internal combustion engine;

a vane rotor that is rotatable synchronously with a camshaft of the internal combustion engine and thereby cooperates with the camshaft to form a synchronously rotatable member, wherein the vane rotor partitions between an advancing chamber and a retarding chamber in a rotational direction in an inside of the housing, and a rotational phase of the vane rotor relative to the housing is changeable in one of an advancing side and a retarding side by feeding hydraulic fluid, which is supplied from a supply source, into a corresponding one of the advancing chamber and the retarding chamber; and a control valve that is received in the synchronously rotatable member and controls input and output of the hydraulic fluid relative to the advancing chamber and the retarding chamber in response to an operational position of a spool, which is received in a sleeve, wherein:

valve timing of a valve, which is opened or closed by the camshaft, is adjusted by transmission of a torque from the crankshaft;

the sleeve includes:

a supply port, to which the hydraulic fluid is supplied from the supply source;

a drain port, which is opened to atmosphere and from which the hydraulic fluid is discharged;

an advancing port, which is adapted to be communicated with the supply port to feed the hydraulic fluid to the advancing chamber during an operation in an advancing mode, which changes the rotational phase toward an advancing side, wherein the advancing port is adapted to be communicated with the drain port to discharge the hydraulic fluid from the advancing chamber during an operation in a retarding mode, which changes the rotational phase toward a retarding side; and a retarding port, which is adapted to be communicated with the supply port to feed the hydraulic fluid to the retarding chamber during the operation in the retarding mode, wherein the retarding port is adapted to be communicated with the drain port to discharge the hydraulic fluid from the retarding chamber during the operation in the advancing mode;

the drain port, the advancing port and the retarding port are displaced from each other in an axial direction of the sleeve; and the synchronously rotatable member includes:

a drain passage that is circumferentially displaced in a circumferential direction of the sleeve from the drain port, which is located on a radially inner side of the drain passage, wherein the drain passage is formed as a through-hole and opens the drain port to the atmosphere;

an advancing passage that is placed in the circumferential direction of the sleeve at a corresponding circumferential position, which coincides with a circumferential position of the advancing port located on a radially inner side of the advancing passage, wherein the advancing passage is formed as a through-hole and communicates the advancing port to the advancing chamber; and a retarding passage that is placed in the circumferential direction of the sleeve at a corresponding circumferential position, which coincides with a circumferential position of the retarding port located on a radially inner side of the retarding passage, wherein the retarding passage is formed as a through hole and communicates the retarding port to the retarding chamber.

6. The valve timing control apparatus according to claim 5, wherein:

the advancing port and the retarding port are located on one axial side and the other axial side, respectively, of the drain port in the axial direction of the sleeve; and an amount of axial positional displacement between the advancing port and the drain port measured in the axial direction of the sleeve is substantially the same as an amount of axial positional displacement between the retarding port and the drain port measured in the axial direction of the sleeve.

7. The valve timing control apparatus according to claim 5, wherein:

the advancing passage and the retarding passage are arranged such that an axially projected shadow of the advancing passage, which is axially projected to the drain passage side, and an axially projected shadow of the retarding passage, which is axially projected to the drain passage side, are located on one circumferential side and the other circumferential side, respectively, of the drain passage in the circumferential direction of the sleeve; and an amount of circumferential positional displacement between the axially projected shadow of the advancing passage and the drain passage measured in the circumferential direction of the sleeve is substantially the same as an amount of circumferential positional displacement between the axially projected shadow of the retarding passage and the drain passage measured in the circumferential direction of the sleeve.

8. The valve timing control apparatus according to claim 5, wherein the sleeve includes a drain opening, which is configured as an annular groove that is formed in an outer peripheral surface of the sleeve and circumferentially extends to communicate between the drain port of the sleeve and the drain passage of the synchronously rotatable member.

* * * * *